US008186827B2

(12) United States Patent
Kubota et al.

(10) Patent No.: US 8,186,827 B2
(45) Date of Patent: May 29, 2012

(54) INKJET RECORDING MEDIUM AND INKJET RECORDING METHOD

(75) Inventors: Tomoya Kubota, Fujinomiya (JP); Hirokazu Shimada, Fujinomiya (JP)

(73) Assignee: FUJIFILM Corporation, Tokyo (JP)

( * ) Notice: Subject to any disclaimer, the term of this patent is extended or adjusted under 35 U.S.C. 154(b) by 820 days.

(21) Appl. No.: 12/203,706

(22) Filed: Sep. 3, 2008

(65) Prior Publication Data

US 2009/0066774 A1 Mar. 12, 2009

(30) Foreign Application Priority Data

Sep. 6, 2007 (JP) ..... 2007-231479

(51) Int. Cl.
*B41J 2/01* (2006.01)
*B41M 5/50* (2006.01)

(52) U.S. Cl. ..... 347/105; 428/32.22

(58) Field of Classification Search ..... 347/105; 428/32.22

See application file for complete search history.

(56) References Cited

U.S. PATENT DOCUMENTS

| | | | | |
|---|---|---|---|---|
| 5,988,635 | A * | 11/1999 | Ohshima | 271/274 |
| 6,610,389 | B2 * | 8/2003 | Ishimaru et al. | 428/195.1 |
| 2009/0068360 | A1 * | 3/2009 | Shimada et al. | 427/256 |

FOREIGN PATENT DOCUMENTS

| | | | |
|---|---|---|---|
| JP | 10-120234 | A | 5/1998 |
| JP | 2001-072274 | A | 3/2001 |
| JP | 2002-144701 | A | 5/2002 |
| JP | 2002-274010 | A | 9/2002 |
| JP | 2002-292997 | A | 10/2002 |
| JP | 2003-048373 | A | 2/2003 |
| JP | 2003-291483 | A | 10/2003 |
| JP | 2003-291506 | A | 10/2003 |
| JP | 2004-174729 | A | 6/2004 |
| JP | 2004-299162 | A | 10/2004 |
| JP | 2005-054308 | A | 3/2005 |
| JP | 2006-001028 | A | 1/2006 |
| JP | 2006-142488 | A | 6/2006 |
| JP | 2006-207055 | A | 8/2006 |
| JP | 2006-305997 | A | 11/2006 |

OTHER PUBLICATIONS

Machine-generated translation of JP 2002-292997, published on Oct. 2002.*

Machine-generated translation of JP 2003-291483, published on Oct. 2003.*

Machine-generated translation of JP 2003-291506, published on Oct. 2003.*

Machine-generated translation of JP 2004-299162, published on Oct. 2004.*

EP Communication, dated May 12, 2009, issued in corresponding EP Application No. 08015546.8, 7 pages.

Notice of Reasons for Rejection, dated Sep. 13, 2011, issued in corresponding JP Application No. 2007-231479, 5 pages in English and Japanese.

Notice of Reasons for Rejection, dated Dec. 20, 2011, issued in corresponding JP Application No. 2007-231479, 5 pages in English and Japanese.

* cited by examiner

*Primary Examiner* — Huan Tran

(74) *Attorney, Agent, or Firm* — Sughrue Mion, PLLC

(57) ABSTRACT

An inkjet recording medium comprising a resin coated sheet formed from a base paper having both sides coated with a resin, and ink receiving layers provided on both sides of the resin coated sheet as outermost layers, wherein a static friction coefficient between at least one of the ink receiving layers and a metal roller onto which wear-resistant particles are adhered is from 0.3 to 0.6.

10 Claims, No Drawings

INKJET RECORDING MEDIUM AND INKJET RECORDING METHOD

CROSS-REFERENCE TO RELATED APPLICATION

This application claims priority under 35 USC 119 from Japanese Patent Application No. 2007-231479, the disclosure of which is incorporated by reference herein.

BACKGROUND OF THE INVENTION

1. Field of the Invention

The present invention relates to an inkjet recording medium and an inkjet recording method.

2. Description of the Related Art

Supports for inkjet recording media have, in most cases, reiterative patterns of a logo mark that identifies the supplier of the inkjet recording media on the backside surface of the substrate paper of the supports. Suppliers of the substrate paper change print patterns in order to correspond to the logo marks for each supplier of inkjet recording media, who are the purchaser of the substrate paper.

However, while the substrates provided with a logo mark that indicates an original brand of individual camera shops or similar photo-printing service shops, or a logo mark specialized for a campaign period, may be considered to be advantageous for the suppliers in view of developing their individual business strategies, an insufficient use amount (production amount) of such substrates has made provision thereof virtually unrealizable in most cases, in consideration of productivity.

Consequently, it has been considered to be advantageous and has been demanded in view of cost or business strategy to enable individual camera shops or similar photo-printing service shops to print a logo mark of their original brand, or a logo mark specialized for a campaign period, onto their products which have already been provided with an image receiving layer for inkjet recording.

In order to address the above problem, a method has been provided in which printing of a logo mark, which is performed prior to coating a paper substrate with a resin, is carried out by use of an inkjet head having an ink ejecting nozzle array of the entire width perpendicular to a running direction of a web, or by means of an electrophotographic method in which toner is transferred onto a web (see, for example, Japanese Patent Application Laid-Open (JP-A) No. 2006-142488).

Further, there have been known a support for inkjet recording media with a back surface having an ability of absorbing ink (see, for example, JP-A Nos. 2005-54308 and 2006-207055) and an inkjet recording medium used for a postcard including a base substrate having one surface thereof coated with a resin (see, for example, JP-A No. 2006-305997).

Further, it has been proposed to include organic spherical particles having an average particle diameter of from 1 to 20 μm in at least one of ink receiving layers provided on each surface of a double-sided inkjet recording sheet (see, for example, JP-A No. 2002-292997).

Further, an inkjet recording material has been known in which a front surface is formed from a coating liquid containing a slight amount of inorganic fine particles having an average diameter of from 1 to 20 μm among inorganic fine particles having a primary particle diameter of from 3 to 30 nm, and a back surface is formed from a resin that improves a static friction coefficient with respect to a metal roller, in order to reduce a friction coefficient between the front surface and the back surface, which is necessary in a process of initial paper supply in a printer, and to improve a static friction coefficient between the back surface and a metal roller, which is necessary in a process of conveying the inkjet recording material while ejecting ink (see, for example, JP-A No. 2003-48373).

However, the technique described in JP-A No. 2006-142488, which is not suited to small-lot production, forces high-cost production on such needs for individual camera shops as printing their original logo marks. The cost would be increased even more if printing of plural kinds of original logo marks in small lots is demanded.

In the techniques described in JP-A Nos. 2005-54308 and 2006-207055, a special operation is required to correct warping of a recording medium that occurs at the time of forming a logo mark due to the nature of cast coat paper used in the recording medium, which makes the process expensive and not suitable for small-lot production. Moreover, there is a fear of causing trouble in conveying the recording medium in an inkjet printer due to a high friction coefficient at each surface of the recording medium.

In the technique described in JP-A No. 2006-305997, inorganic fine particles having a large size used on an address side of the recording medium may cause a slight slippage of a roller during conveying of the recording medium in a printer, resulting in banding (white deletion and print streaks). Moreover, since only one side of the recording medium is coated with a resin, there is a fear of causing curling after formation of a logo mark, or image disorder upon contact with a print head.

In the technique described in JP-A No. 2002-292997, inorganic fine particles of a large size used in an ink receiving layer may degrade a color formation property after ejection of ink. Moreover, since only a friction coefficient at front and back surfaces with another inkjet recording medium is taken into consideration, the accuracy in conveyance at an area onto which ink is to be ejected may be poor and banding may be caused.

In the technique described in JP-A No. 2003-48373, a logo mark cannot be printed on a back side of the inkjet recording medium on which no ink receiving layer is provided. Moreover, density or glossiness of a highly precise image may be lowered due to inorganic fine particles with an average diameter of 1 to 20 μm contained in a surface onto which the image is to be formed.

SUMMARY OF THE INVENTION

The present invention has been made in view of the above circumstances and provides an inkjet recording medium and an inkjet recording method.

A first aspect of the invention provides an inkjet recording medium comprising a resin coated sheet formed from a base paper having both sides coated with a resin, and ink receiving layers provided on both sides of the resin coated sheet as outermost layers, wherein a static friction coefficient between at least one of the ink receiving layers and a metal roller onto which wear-resistant particles are adhered is from 0.3 to 0.6.

A second aspect of the invention provides an inkjet recording method comprising recording an image on at least one surface of an inkjet recording medium, the inkjet recording medium comprising a resin coated sheet formed from a base paper having both sides coated with a resin and ink receiving layers provided on both sides of the resin coated sheet as outermost layers, wherein the recording is performed such that a static friction coefficient between the ink receiving layer onto which the image is recorded and a feed roller in an inkjet printer formed from a metal roller onto which wear-resistant particles are adhered is from 0.3 to 0.6.

DETAILED DESCRIPTION OF THE INVENTION (Inkjet Recording Medium)

The inkjet recording medium of the present invention includes a resin-coated sheet made of a paper substrate having both sides coated with a resin, and ink receiving layers formed on the both sides of the resin-coated sheet as outermost layers. The static friction coefficient between at least one of the ink receiving layers and a feed roller of an inkjet printer made of a highly rigid roller, such as a metal roller, onto which wear-resistant particles are adhered is from 0.3 to 0.6.

Since the inkjet recording medium of the present invention has the above structure, accuracy of sheet feeding can be maintained at high level, and occurrence of offset or curling after recording an image can be prevented.

Therefore, according to the inkjet recording medium of the invention, for example, by using a surface having the above static friction coefficient of 0.3 to 0.6 as a backside surface, printing can be conducted without causing banding on the front surface even when the inkjet recording medium is rolled up or cut into an arbitrary size. Accordingly, the inkjet recording material of the invention is particularly suitable for individual camera shops or similar photo-printing service shops to print a logo mark of their original brand or a logo mark specialized for a campaign period at low cost.

In the invention, a surface onto which a high quality image can be formed is referred to as a "front surface" and a surface opposite to the front surface is referred to as a "back surface".

In the invention, a "feed roller for an inkjet printer made of a highly rigid roller onto which wear-resistant particles are uniformly adhered" refers to a feed roller used for conveying a recording medium, which is designed such that the friction coefficient between the roller and the surface of the inkjet recording medium and a holding force of the roller for the recording medium are improved. Specifically, a feed roller, in which ceramic particles (made of alumina or silicon carbide) having an average diameter of from 20 μm to 70 μm are adhered to the surface of a highly rigid roller such as a metal roller, at a distribution density of 20% to 80% with respect to the surface area of the roller. As a highly rigid roller, for example, those described in JP-A No. 2001-72274, at paragraph numbers of [0058] to [0063] may be used.

Examples of such a feed roller include a feed roller made of a highly rigid roller onto which wear-resistant particles are adhered, which is installed in a printer (for example, PM-G800: trade name manufactured by Seiko Epson Corp., Lot No. C55101005NA04702276), and a roller having a similar design to the above roller.

The "static friction coefficient" in the present invention refers to a value measured by the use of a surface property tester (TRIBOGEAR type 14DR (trade name) manufactured by Shinto Scientific Co., Ltd.) as a measuring instrument in accordance with JIS P 8147. However, since the feed roller has a cylindrical shape, the static friction coefficient is measured by the following process.

First, the cylinder is cut by two planes that are parallel to end surfaces of the cylinder into 60-mm length, and the outer peripheral surface of the cut piece of the feed roller is adhered to a surface of a 60-mm-square stainless steel plate with an adhesive. Thereafter, a double-faced adhesive tape is adhered onto the entire area of a surface of the stainless steel plate opposite to the side onto which the feed roller is adhered, and this is fixed to the measuring instrument. Thereafter, an A4-size inkjet recording medium is prepared and placed such that a back surface of the recording medium is in contact with the feed roller, and the static friction coefficient is measured at a test speed of 7 mm/minute.

In the invention, when the static friction coefficient is less than 0.3, accuracy of feeding may be deteriorated, and when the static friction coefficient exceeds 0.6, accuracy of feeding may also be deteriorated. Therefore, from the viewpoint of maintaining accuracy of feeding, the static friction coefficient is preferably from 0.3 to 0.6, and more preferably from 0.4 to 0.55.

(Ink Receiving Layer)

The inkjet recording medium of the invention has ink receiving layers on both sides of a later-described "resin coated paper formed from a paper substrate having both sides coated with a resin", as outermost layers located farthest from the resin coated paper.

The ink receiving layer of the invention may contain, although not specifically limited, components such as fine particles, a water-soluble resin, a water-soluble polyvalent metal salt compound, a cation-modified polymer latex, a crosslinking agent and a mordant.

(Fine Particles)

The ink receiving layer of the ink jet recording medium of the invention may contain at least one kind of fine particles. By containing the fine particles, the ink receiving layer can acquire a porous structure, and by which ink absorbing performance of the ink receiving layer can be improved. In particular, when the solid content of fine particles in the ink receiving layer is 50% by mass or more, more preferably more than 60% by mass, it is preferable since an even superior porous structure can be formed and an ink jet recording medium having a sufficient ink absorbing property can be obtained.

The solid content of fine particles in the ink receiving layer herein is calculated based on the components except water or other solvents in the composition for the ink receiving layer.

While the fine particles used in the invention are preferably inorganic fine particles, organic fine particles may be used so long as the particles do not impair the effect of the invention.

Preferable organic fine particles include polymer fine particles obtained by emulsion polymerization, micro-emulsion polymerization, soap-free polymerization, seed polymerization, dispersion polymerization, suspension polymerization, or the like: for example, polymer fine particles in the form of powder, latex, emulsion or the like of polyethylene, polypropylene, polystyrene, polyacrylate, polyamide, silicone resin, phenol resin, natural polymer or the like.

When organic fine particles are used, they are preferably cationized and, since the organic fine particles mainly constitute a porous column material, the organic fine particles preferably has no film forming property or in a small amount, if any, and preferably has a minimum film forming temperature (MFT) of 50° C. or more, more preferably 120° C. or more.

Examples of the inorganic fine particles include those of silica, colloidal silica, titanium dioxide, barium sulfate, calcium silicate, zeolite, kaolinite, halloysite, mica, talc, calcium carbonate, magnesium carbonate, calcium sulfate, pseudo-boehmite aluminum hydroxide (simply referred to as pseudo-boehmite), zinc oxide, zinc hydroxide, alumina, aluminum silicate, calcium silicate, magnesium silicate, zirconium oxide, zirconium hydroxide, cerium oxide, lanthanum oxide, and yttrium oxide. Among these, silica fine particles, colloidal silica, alumina fine particles and pseudo-boehmite are preferable from the viewpoint of forming a favorable porous structure.

The fine particles may be used directly as primary particles, or in the form of secondary particles. The average primary particle diameter of the fine particles is preferably 2 μm or less, and more preferably 200 nm or less.

Furthermore, silica fine particles with an average primary particle diameter of 20 nm or less, colloidal silica with an average primary particle diameter of 30 nm or less, alumina fine particles with an average primary particle diameter of 20 nm or less, and pseudo-Boehmite with an average fine pore diameter of from 2 to 15 nm are more preferable, and silica fine particles, alumina fine particles and pseudo-Boehmite are particularly preferable.

Silica fine particles are roughly classified into particles produced by a wet method and particles produced by a dry method (gas phase method). In the wet method, typically, active silica that has been formed by acidolysis of a silicate salt is appropriately polymerized, followed by coagulation and precipitation, thereby forming hydrated silica. In contrast, in a gas-phase method, anhydrous silica is typically obtained by hydrolysis of silicon halide in a gas phase at a high temperature (flame hydrolysis method), or by heating silica sand and coke to cause reduction and vaporization thereof with arc in an electric furnace, and then oxidizing the product with air (arc method). The "gas phase silica" or "fumed silica" means anhydrous silica fine particles obtained by a gas phase method. The silica fine particles used in the invention are particularly preferably fumed silica particles.

Fumed silica exhibits different properties from those of hydrated silica due to differences in density of silanol groups on the surface, presence or absence of voids, and is suitable for forming a three-dimensional structure with a high void ratio. While the reason thereof is not clear, it is presumed that the density of the silanol groups on the surface of the fine particles is as large as 5 to 8/nm$^2$ in hydrated silica, which makes silica particles readily aggregate. In contrast, the density of the silanol group on the surface of the fine particles is as small as 2 to 3/nm$^2$ in fumed silica, which leads to formation of coarse and soft flocculates, resulting in a structure with a high void ratio.

Since fumed silica has a particularly high specific surface area, efficiency of absorbing and retaining ink is high. In addition, due to its low refractive index, transparency can be imparted to the ink receiving layer and a high color density and a favorable coloring property can be obtained by performing dispersion of the particles until they have a proper particle diameter. It is important that the ink receiving layer is transparent not only in applications where being transparent is required, such as an OHP film, but also in applications as a recording sheet such as a photographic glossy paper sheet, in order to obtain a high color density, favorable coloring property and glossiness.

The average primary particle diameter of the fumed silica is preferably 1 to 30 nm, more preferably 1 to 20 nm, particularly preferably 1 to 10 nm, and most preferably 3 to 10 nm. Since fumed silica particles are liable to bond to each other via a hydrogen bond between silanol groups, a structure having a large void ratio can be formed and ink absorbing characteristics may be effectively improved, when the average primary particle diameter is 30 nm or less.

The silica fine particles may be used together with other fine particles. In this case, the content of fumed silica is preferably 30% by mass or more, and is more preferably 50% by mass or more.

Particles of alumina, alumina hydrate, and a mixture or composite thereof are also preferable as the inorganic fine particles used in the invention. Alumina hydrate is preferable among them since it favorably absorbs and fixes ink, and pseudo-Boehmite ($Al_2O_3.nH_2O$) is particularly preferable. While various forms of alumina hydrate are applicable, Boehmite sol is preferably used as a raw material since it readily forms a smooth surface.

The fine void structure of pseudo-Boehmite has an average fine void diameter of preferably from 1 to 30 nm, and more preferably from 2 to 15 nm. The fine void volume is preferably from 0.3 to 2.0 cc/g, and more preferably from 0.5 to 1.5 cc/g. The fine void diameter and fine void volume can be measured by a nitrogen absorption-desorption method using, for example, a gas absorption-desorption analyzer (for example, OMNISORP 369 manufactured by Beckman Coulter, Inc.).

Among the alumina fine particles, humed alumina fine particles are preferable for its high specific surface area. The average primary particle diameter of fumed alumina is preferably 30 nm or less, and is more preferably 20 nm or less.

When colloidal silica or titanium dioxide is used, there is a possibility that sufficient void ratio may not be obtained due to their small ability of forming voids. However, it is effective to apply a method of including silica fine particles and colloidal silica in the same layer or a method of superposing a layer containing colloidal silica and a layer containing titanium dioxide, or the like, in order to exert the effect of the invention.

The fine particles may be subjected to a surface treatment with a silane coupling agent. As the silane coupling agent, those having organic functional group (such as a vinyl group, amino group (primary to tertiary amino groups, quaternary ammonium salt group), epoxy group, mercapto group, chloro group, alkyl group, phenyl group and ester group) are preferably used.

In employing the above-mentioned fine particles in an ink-jet recording medium, embodiments disclosed in JP-A Nos. 10-81064, 10-119423, 10-157277, 10-217601, 11-348409, 2001-138621, 2000-43401, 2000-211235, 2000-309157, 2001-96897, 2001-138627, 11-91242, 8-2087, 8-2090, 8-2091, 8-2093, 8-174992, 11-192777 and 2001-301314 are also preferably used.

(Water Soluble Resin)

The ink jet recording medium of the invention may contain at least one water soluble resin in the ink receiving layer.

Examples of the water soluble resin include polyvinyl alcohol resins having hydroxyl groups as a hydrophilic structural unit (for example, polyvinyl alcohol (PVA), acetoacetyl-modified polyvinyl alcohol, cation-modified polyvinyl alcohol, anion-modified polyvinyl alcohol, silanol-modified polyvinyl alcohol and polyvinyl acetal), cellulose resins (methyl cellulose (MC), ethyl cellulose (EC), hydroxyethyl cellulose (HEC), carboxymethyl cellulose (CMC), hydroxypropyl cellulose (HPC), hydroxyethylmethyl cellulose and hydroxypropylmethyl cellulose), chitins, chitosans, starch, resins having ether bonds (polyethylene oxide (PEO), polypropylene oxide (PPO), polyethyleneglycol (PEG) and polyvinyl ether (PVE)), resins having carbamoyl groups (polyacrylamide (PAAM), polyvinyl pyrrolidone (PVP) and polyacrylic acid hydrazide).

Those having carboxyl groups as dissociation groups, such as polyacrylic acid salts, maleic acid resins, alginic acid salts and gelatins, may also be included in the examples.

Among the above polymers, polyvinyl alcohol resins, cellulose resins, resins having ether bonds, resins having carbamoyl groups, resins having carboxyl groups, and gelatins are preferable, and polyvinyl alcohol resins are particularly preferable.

Examples of the polyvinyl alcohol resins include those described in Japanese Patent Application Publication (JP-B) Nos. 4-52786, 5-67432 and 7-29479, Japanese Patent No.

2537827, JP-B No. 7-57553, Japanese Patent Nos. 2502998 and 3053231, JP-A No. 63-176173, Japanese Patent No. 2604367, JP-A Nos. 7-276787, 9-207425, 11-58941, 2000-135858, 2001-205924, 2001-287444, 62-278080 and 9-39373, Japanese Patent No. 2750433, JP-A Nos. 2000-158801, 2001-213045, 2001-328345, 8-324105 and 11-348417.

Compounds described in paragraphs [0011] to [0014] in JP-A No. 11-165461 may also be included in the examples of water soluble resins other than polyvinyl alcohol resins.

These water soluble resins may be used alone, or in a combination of two or more of them.

The content of the water soluble resin of the invention is preferably from 9 to 40% by mass and is more preferably from 12 to 33% by mass, with respect to the total solid content of the ink receiving layer.

The water soluble resin and fine particles that are main components of the ink receiving layer of the invention may be comprised of a single material, or may be a mixed material of plural materials, respectively.

From the viewpoint of maintaining transparency, the type of the water soluble resin to be combined with fine particles, particularly with silica fine particles, is important. Polyvinyl alcohol is preferable as the water soluble resin when fumed silica is used. Among these, polyvinyl alcohol with a saponification degree of from 70 to 100% is preferable, and polyvinyl alcohol with a saponification degree of from 80 to 99.5% is particularly preferable.

Moreover, from the viewpoint of maintaining image density or preventing curling of a recording medium to the ink receiving layer side, polyvinyl alcohol with a saponification degree of from 75 to 95% is preferable, and polyvinyl alcohol with a saponification degree of from 80 to 90% is particularly preferable.

The polymerization degree of polyvinyl alcohol is preferably from 1400 to 1500, and is more preferably from 2300 to 4000, from the viewpoint of obtaining sufficient film strength. Polyvinyl alcohol with a polymerization degree of less than 1400 and polyvinyl alcohol with a polymerization degree of 1400 or more may be used in combination.

The above-mentioned polyvinyl alcohol resins, having hydroxyl groups in its structural unit that form hydrogen bonds with silanol groups on the surface of silica fine particles, facilitate formation of a three dimensional network structure in which secondary particles of the silica fine particles serve as a network chain unit. It is presumed that by the formation of such a three dimensional network structure, an ink receiving layer having a porous structure with a high void ratio and sufficient strength is formed.

In inkjet recording, the porous ink receiving layer obtained as described above rapidly absorbs ink by its capillary action, and forms favorable dots having a high degree of circularity that do not cause ink bleeding.

The polyvinyl alcohol resin may be used in combination with other types of water soluble resins as mentioned above. When the other water soluble resin is used with the polyvinyl alcohol resin, the content of the polyvinyl alcohol resin in the total water soluble resins is preferably 50% by mass or more, and is more preferably 70% by mass or more.

When a cation-modified polymer latex as described later having a glass transition temperature (Tg) of 40° C. or less is used, it is preferable that at least part of the polyvinyl alcohol has an acetoacetic acid ester group, from the viewpoint of increasing the strength of the ink receiving layer. When using the polyvinyl alcohol having an acetoacetic acid ester group, a crosslinking agent described in JP-A Nos. 2004-277367, 2004-268576, 2004-168853, 2004-83756 or 2003-301084 is preferably used in combination. Among these, compounds containing zirconium such as ammonium zirconium acetate and ammonium zirconium carbonate are preferable from the viewpoint of increasing the strength of the ink receiving layer.

<Composition Ratio of Fine Particles and Water Soluble Resin>

The mass composition ratio (PB ratio (x/y)) of fine particles (x) and a water soluble resin (y) largely affect the structure and strength of the ink receiving layer. As the mass composition ratio (PB ratio) increases, the void ratio, fine void volume and surface area (per unit mass) tend to increase: however, the density and strength tend to decrease.

The mass composition ratio (PB ratio, (x/y)) of the ink receiving layer of the invention is preferably 1.5 to 10, in view of preventing reduction in the layer strength and occurrence of cracks caused by drying due to too large PB ratio, and preventing reduction in ink absorbing ability due to blocking of voids with the resin and reduction in the void ratio due to too small PB ratio.

Since a strain may be applied on a recording sheet when the recording sheet is conveyed in a conveyer system of an ink jet printer, it is necessary that the ink receiving layer has a sufficient film strength. Further, it is necessary that the ink receiving layer has a sufficient strength also in view of preventing cracks and peeling of the ink receiving layer when cutting or processing the recording sheet. In view of the above, the mass ratio (x/y) is more preferably 5 or less, and from the viewpoint of securing an ability of rapidly absorbing ink in an inkjet printer, the mass ratio is more preferably 2 or more.

For example, when a layer is formed by coating a substrate with a liquid containing fumed silica fine particles with an average primary diameter of 20 nm or less and a water soluble resin that are completely dispersed in water at a mass ratio (x/y) of 2 to 5 and drying it, a three-dimensional network structure including network chains of secondary particles of the silica fine particles is formed. In this way, a light-permeable porous layer with an average fine void diameter of 30 nm or less, a void ratio of 50% to 80%, a specific void volume of 0.5 ml/g or more, and a specific surface area of 100 $m^2/g$ or more can be readily formed.

(Cross-Linking Agent)

The ink receiving layer of the invention preferably is a layer containing fine particles and a water soluble resin, and further containing a cross-linking agent that can cross-link at least the water soluble resin, and is preferably a porous layer obtained by curing the coated layer by a cross-linking reaction between the fine particles and the cross-linking agent.

Boron compounds are preferably used for cross-linking of the water soluble resin, particularly a polyvinyl alcohol resin. Examples of the boron compound include borax, boric acid, borate (for example orthoborate, $InBO_3$, $ScBO_3$, $YBO_3$, $LaBO_3$, $Mg_3(BO_3)_2$ and $Co_3(BO_3)_2$), diborate (for example $Mg_2B_2O_5$, $Co_2B_2O_5$), metaborate (for example $LiBO_2$, $Ca(BO_2)_2$, $NaBO_2$ and $KBO_2$), tetraborate (for example $Na_2B_4O_7.10H_2O$), and pentaborate (for example $KB_5O_8.4H_2O$, $Ca_2B_6O_{11}.7H_2O$, and $CsB_5O_5$). Among these, in view of causing a rapid cross-linking reaction, borax, boric acids and borates are preferable, and boric acid is particularly preferable.

The amount of the cross-linking agent with respect to the above-mentioned aqueous solution is preferably from 1% to 50% by mass, and is more preferably from 5% to 40% by mass.

(Water Soluble Polyvalent Metal Salt Compound)

The ink receiving layer of the invention may contain at least one of a water soluble polyvalent metal salt compound.

As the water soluble polyvalent metal salt compound, those of metals such as calcium, barium, manganese, cupper, cobalt, nickel, aluminum, iron, zinc, zirconium, chromium, magnesium, tungsten, and molybdenum can be mentioned. The water soluble polyvalent metal salt compound can suppress bleeding in an image that occurs with time (moisture resistance in a high-humidity environment), and is also effective to improve gas-resistant and light-resistant properties.

The content of the water soluble polyvalent metal salt compound in the ink receiving layer is preferably from 0.1 to 10% by mass, more preferably from 1 to 5% by mass, with respect to the fine particles. The amount of the water soluble polyvalent metal salt compound in the ink receiving layer is preferably from 0.01 to 5 $g/m^2$ and is more preferably from 0.1 to 3 $g/m^2$.

(Cation-Modified Polymer Latex)

The ink receiving layer of the invention may contain at least one kind of a cation-modified polymer latex.

The cation-modified polymer latex is a product prepared by emulsification or dispersion of a non-water soluble polymer into the form of a colloid dispersion with a particle diameter of from 0.001 to 0.1 μm, or an emulsion with a radius of 0.1 μm or more, and examples thereof include latexes of polystyrene-type, styrene-butadiene copolymer-type, acrylonitrile-butadiene-type, acrylic acid-type, styrene-acrylic acid-type, urethane-type, methacrylic acid-type, vinyl chloride-type, vinyl acetate-type, ethylene-vinyl acetate type, and the like. Containing a cation-modified polymer latex is effective in improving the strength of the ink receiving layer, preventing formation of scratches on the surface of the ink receiving layer at the time of conducting inkjet recording, and improving the moisture resistance of an image after being recorded (preventing bleeding of ink due to moisture and heat).

The amount of the cation-modified polymer latex is preferably from 1 to 30% by mass and is more preferably from 2 to 15% by mass, with respect to the amount of the fine particles. When the amount is in the above range, increase in viscosity of a liquid can be suppressed, which is effective to stability the viscosity, and to form a film having a favorable surface by an application method.

(Mordant)

The ink receiving layer of the invention may contain at least one mordant. As a mordant, a cationic polymer (cationic mordant) as an organic mordant, or an inorganic mordant is preferably used. The organic or inorganic mordant may be used singly or in combination.

Other components than the aforementioned cross-linking agent, water-soluble polyvalent metal salt compound, cation-modified polymer latex and mordant, for example, components described in JP-A No. 2006-334911, paragraphs [0086] to [0161] may also be appropriately selected and used.

The method of forming the ink receiving layer of the invention is not particularly limited, but a method described in JP-A No. 2006-334911, paragraphs [0179] to [0227], for example, may be appropriately optimized and used.

(Preferred Embodiments of Ink Receiving Layer)

An embodiment of the ink receiving layer of the invention with a static friction coefficient of from 0.3 to 0.6 is not particularly limited, but the following first embodiment and second embodiment are preferable.

The first embodiment of the ink receiving layer with a static friction coefficient of from 0.3 to 0.6 contains at least one kind of inorganic fine particles having an average secondary particle diameter of from 50 nm to less than 300 nm selected from amorphous silica particles, colloidal silica, alumina fine particles and pseudo-Boehmite, and a matting agent having a diameter of from 2 μm to 20 μm (preferably 5 μm to 15 μm).

By incorporating the matting agent having a diameter of from 2 μm to 20 μm into the ink receiving layer with a static friction coefficient of from 0.3 to 0.6, when two or more sheets of inkjet recording media are stacked, the friction coefficient of one ink receiving layer to the other can be reduced, and the two or more sheets of recording media can be effectively prevented from being simultaneously fed into a printer. As the matting agent, known matting agents can be used.

When the matting agent is contained in the ink receiving layer and the average secondary diameter of the inorganic fine particles is 50 nm or more, the particles can be effectively prevented from densely gathering, and the ability of absorbing ink can be further enhanced. Accordingly, occurrence of beading or offset can be more effectively prevented.

When the matting agent is contained in the ink receiving layer and the average secondary diameter of the inorganic fine particles is less than 300 nm, the static friction coefficient of the ink receiving layer with a feed roller can be maintained at a higher level, and improper feeding or banding can be more effectively prevented.

Details of the amorphous silica particles, colloidal silica, alumina fine particles and pseudo-Boehmite are as discussed above. The "amorphous silica particles" mentioned here are synonymous with the aforementioned "silica fine particles".

The second embodiment of the ink receiving layer with a static friction coefficient of from 0.3 to 0.6 contains inorganic fine particles with an average secondary particle diameter of from 300 nm to less than 1,000 nm and the content of the matting agent is 0.01% by mass or less.

When the matting agent is contained in the ink receiving layer in an amount of 0.01% by mass or less and the average secondary diameter of the inorganic fine particles is in the above range, the static friction coefficient of the ink receiving layer with a feed roller can be maintained at a higher level, and improper feeding or banding can be more effectively prevented.

(Resin Coated Sheet Having Both Sides Coated With Resin)

In the inkjet recording medium of the invention, a resin coated sheet formed by coating both sides of a substrate paper (hereinafter, sometimes referred to as "base paper") with a resin is used.

The thickness of the resin coated sheet is not specifically limited, but is preferably from 50 μm to 300 μm from the viewpoint of handling.

The surface of the resin coated sheet may be subjected to a corona discharge treatment, glow discharge treatment, flame treatment, ultraviolet irradiation treatment or the like, in order to improve a wetting property and an adhesive property.

The base paper is formed from wood pulp as a main raw material, and optionally a synthetic pulp such as polypropylene or synthetic fibers such as nylon and polyester. As the wood pulp, any of LBKP, LBSP, NBKP, NBSP, LDP, NDP, LUKP and NUKP may be used, and LBKP, NBSP, LBSP, NDP and LDP containing short fibers is preferably used in a larger amount.

The content ratio of LBSP and/or LDP is preferably from 10% by mass to 70% by mass.

The pulp is preferably a chemical pulp containing less impurities (sulfate pulp and sulfite pulp), and a pulp that has been subjected to a bleaching treatment to improve whiteness is also useful.

Other additives that may be optionally added to the base paper include sizing agents such as a higher fatty acid and alkyl ketenedimer, white pigments such as calcium carbonate, talc and titanium oxide, strengthening agents such as starch, polyacrylamide and polyvinyl alcohol, fluorescent brighteners, water-holding agents such as polyethylene glycol, dispersants, and softening agents such as quaternary ammonium.

The freeness as stipulated by CSF of the pulp used for papermaking is preferably from 200 ml to 500 ml, and the fiber length after beating is preferably such that the total of a 24-mesh residue (% by mass) and a 42-mesh residue (% by mass) as stipulated in JIS P-8207 is from 30 to 70%. Further, a 4-mesh residue (% by mass) is preferably 20% by mass or less.

The weight of the base paper is preferably from 30 g to 250 g, and particularly preferably from 50 g to 200 g. The thickness of the base paper is preferably from 40 μm to 250 μm. The base paper may be subjected to a calender treatment in the process of papermaking or after papermaking to impart smoothness to the base paper. The density of the base paper as stipulated in JIS P-8118 is generally from 0.7 to 1.2 g/m$^2$.

Further, the rigidity of the base paper as measured under the conditions stipulated in JIS P-8143 is preferably from 20 g to 200 g.

A surface sizing agent may be applied onto the surface of the base paper, and a similar sizing agent to those that may be added to the base paper may be used as the surface sizing agent. The pH value as measured by a hot water extraction method stipulated in JIS P-8113 of the base paper is preferably from 5 to 9.

The resin used for coating both sides of the base paper is preferably polyethylene. As the polyethylene, a low density polyethylene (LDPE) and/or a high density polyethylene (HDPE) are preferably mainly used, but other polyethylene such as LLDPE or polypropylene may be partly used.

In particular, the resin coating formed on the front surface side preferably has improved opacity, whiteness and color hue, as is widely used in the photographic printing paper, by adding a rutile- or anatase-type titanium oxide, a fluorescent brightener, ultramarine or the like to polyethylene. Here, the content of titanium oxide is preferably approximately from 3 to 20% by mass, and more preferably from 4 to 13% by mass with respect to the amount of polyethylene. The thickness of the resin coating is not specifically limited, but the thickness of the resin coating on both sides of the base paper is preferably from 10 μm to 50 μm. Further, in order to impart adhesiveness between the resin coating and the ink receiving layer, an undercoat layer may be provided on the resin coating. The undercoat layer is preferably made of water-soluble polyester, gelatin or PVA. The thickness of the undercoat layer is preferably from 0.01 μm to 5 μm.

The resin coated sheet may be used as a glossy paper, or may be used as paper having a matte surface or silky surface produced by performing a so-called emboss treatment during coating of a base paper with a resin by melt extrusion, as is used for common photographic printing paper.

The resin coated sheet may be provided with a back coat layer, and components to be added to the back coat layer include white pigments, aqueous binders or other components.

Examples of the white pigments include white inorganic pigments such as light calcium carbonate, heavy calcium carbonate, kaolin, talc, calcium sulfate, barium sulfate, titanium dioxide, zinc oxide, zinc sulfide, zinc carbonate, satin white, aluminum silicate, diatom earth, calcium silicate, magnesium silicate, synthetic amorphous silica, colloidal silica, colloidal alumina, pseudo-Boehmite, aluminum hydroxide, alumina, lithopone, zeolite, hydrated halloysite, magnesium carbonate and magnesium hydroxide; and organic pigments such as styrene-based plastic pigment, acrylic plastic pigment, polyethylene, microcapsules, urea resin and melamine resin.

Examples of the aqueous binder include, for example, water-soluble resins such as styrene/maleic acid copolymer, styrene/acrylic acid salt copolymer, polyvinyl alcohol, silanol-modified polyvinyl alcohol, starch, cationated-starch, casein, gelatin, carboxymethyl cellulose, hydroxyethyl cellulose and polyvinyl pyrrolidone, water-dispersible polymers such as styrene/butadiene latex and acrylic emulsion.

Examples of other components contained in the back coat layer include defoaming agents, foam-suppressing agents, dyes, fluorescent brighteners, aseptic agents and water-repellent agents.

(Inkjet Recording Method)

The inkjet recording method of the invention is a method of recording an image by an inkjet method using an inkjet recording medium made of a resin coated sheet comprised of a base paper having both sides coated with a resin and ink receiving layers formed on both sides of the resin coated sheet as outermost layers, wherein a static friction coefficient between at least one surface of the ink receiving layers and a feed roller formed by adhering wear resistant particles on the surface of a highly rigid roller is from 0.3 to 0.6.

Here, the resin coated sheet, feed roller, ink receiving layer, static friction coefficient are the same as those described in the inkjet recording medium, and preferred ranges are also the same as those described in the inkjet recording medium.

The inkjet recording method of the invention, having the above structure, may keep accuracy of feeding at a high level, and may prevent occurrence of offset or curling after recording an image. Accordingly, in the inkjet recording method of the invention, for example, by using the surface having a static friction coefficient of 0.3 to 0.6 as a backside surface, printing may be carried out without causing banding on a front surface of a recording medium, even if the recording medium is rolled up or cut into an arbitrary size. Consequently, the inkjet recording method of the invention is particularly preferable for individual camera shops or similar photo-printing service shops to print a logo mark of their original brands or a logo mark specialized for a campaign period at low cost.

The following are exemplary embodiments of the present invention.

1. An inkjet recording medium comprising a resin coated sheet formed from a base paper having both sides coated with a resin, and ink receiving layers provided on both sides of the resin coated sheet as outermost layers, wherein a static friction coefficient between at least one of the ink receiving layers and a metal roller onto which wear-resistant particles are adhered is from 0.3 to 0.6.
2. The inkjet recording medium according to 1, wherein the ink receiving layer having the static friction coefficient of from 0.3 to 0.6 contains inorganic fine particles having an average secondary particle diameter of 50 nm or more to less than 300 nm and a matting agent having a particle diameter of from 2 to 20 μm.
3. The inkjet recording medium according to 2, wherein the inorganic fine particles are at least one selected from inorganic fine particles of amorphous silica, colloidal silica, alumina or pseudo-Boehmite.
4. The inkjet recording medium according to 1, wherein the ink receiving layer having the static friction coefficient of from 0.3 to 0.6 contains inorganic fine particles having an average secondary particle diameter of 300 nm or more to less than 1000 nm and a matting agent in an amount of 0.01% by mass with respect to the total ink receiving layer.

5. The inkjet recording medium according to 1, wherein the ink receiving layer having the static friction coefficient of from 0.3 to 0.6 is provided on a back surface of the resin coated sheet.
6. The inkjet recording medium according to 1, wherein the ink receiving layer having the static friction coefficient of from 0.3 to 0.6 contains a water soluble resin.
7. An inkjet recording method comprising recording an image on at least one surface of an inkjet recording medium, the inkjet recording medium comprising a resin coated sheet formed from a base paper having both sides coated with a resin and ink receiving layers provided on both sides of the resin coated sheet as outermost layers, wherein the recording is performed such that a static friction coefficient between the ink receiving layer onto which the image is recorded and a feed roller in an inkjet printer formed from a metal roller onto which wear-resistant particles are adhered is from 0.3 to 0.6.
8. The inkjet recording medium according to 1, wherein the ink receiving layer on which the image is recorded contains at least one kind of inorganic fine particles having an average secondary particle diameter of 50 nm or more to less than 300 nm and a matting agent having a particle diameter of from 2 to 20 μm.
9. The inkjet recording medium according to 8, wherein the inorganic fine particles are at least one selected from inorganic fine particles of amorphous silica, colloidal silica, alumina or pseudo-Boehmite.
10. The inkjet recording medium according to 1, wherein the ink receiving layer on which the image is recorded contains inorganic fine particles having an average secondary particle diameter of 300 nm or more to less than 1000 nm and a matting agent in an amount of 0.01% by mass with respect to the total ink receiving layer.

EXAMPLES

Hereinafter, the invention will be further described in detail with reference to the following examples, but the invention is not limited to the examples. "Part" and "%" are based on mass unless otherwise specified.

Example 1

(Preparation of Support)

50 parts of LBKP produced from acacia and 50 parts of LBKP produced from aspen were beaten by a disc refiner, and a pulp slurry having a Canadian Freeness of 300 ml was prepared.

To the obtained pulp slurry were added 1.3% of cationic starch (CAT 0304L (trade name) manufactured by Nippon NSC Ltd.), 0.15% of anionic polyacrylamide (POLYACRON ST-13 (trade name) manufactured by Seiko PMC Corporation), 0.29% of alkylketene dimmer (SIZE PINE K (trade name) manufactured by Arakawa Chemical Industries Ltd.), 0.29% of epoxydated behenic acid amide, and 0.32% of polyamidepolyamine epichlorohydrin (ARAFIX 100 (trade name) manufactured by Arakawa Chemical Industries Ltd.). Thereafter, 0.12% of a defoaming agent was added thereto. The above percentages are based on the amount of the pulp.

The pulp slurry thus prepared in the above step was subjected to papermaking by use of a fourdrinier paper machine. Drying was performed through a process in which a felt side of a web was pressed against a drum drier cylinder via a drier canvas, by setting a tensile force of the drier canvas at 1.6 Kg/cm. Subsequently, polyvinyl alcohol (KL-118 (trade name) manufactured by Kuraray Co., Ltd.) was applied onto both sides of the obtained paper sheet by size pressing to an amount of 1 g/m$^2$, then dried and subjected to a calender treatment. A base paper (substrate paper) having a weight of 166 g/m$^2$ and a thickness of 160 μm was thus obtained.

After performing a corona discharge treatment to a wire side (back surface) of the obtained substrate paper, the side was coated with high density polyethylene to a thickness of 25 μm by a melt extrusion coater to form a thermoplastic resin layer A with a matte surface (hereinafter, the surface of the thermoplastic resin layer A is sometimes referred to as a "back surface" of the resin coated paper).

Subsequently, a corona discharge treatment was performed to a surface opposite to the back surface of the substrate paper, and the side was coated with low density polyethylene containing 10% of titanium oxide with a melt flow rate (MFR) of 4.0 g/10 min. and a density of 0.93 g/cm$^3$ to an amount of 40.0 g/m$^2$ by a melt extrusion coater to form a thermoplastic resin layer B with a mirror surface (hereinafter, the surface of the thermoplastic resin layer B is referred to as a "front surface" of the resin coated paper sheet). The resin coated sheet having both sides coated with a resin was thus obtained.

(Preparation of Inorganic Fine Particle Dispersion for Coating Liquid for Back Surface)

The following components (1) to (3) were mixed and dispersed by a non-media dispersing machine (ultrasonic dispersing machine manufactured by SMT Co., Ltd.), and the obtained dispersion was heated to 45° C. and maintained at this temperature for 20 hours.

| | |
|---|---|
| (1) Vapor phase synthetic silica (inorganic fine particles) (AEROSIL 300SF75 (trade name), manufactured by Nippon Aerosil Co., Ltd., average primary particle diameter; 7 nm) | 10.0 parts |
| (2) Ion exchange water | 65.8 parts |
| (3) SHAROL DC-902P (trade name) (51.5% aqueous solution) (dispersant, manufactured by Dai-Ichi Kogyo Seiyaku Co., Ltd.) | 0.87 parts |

(Preparation of coating liquid for back surface)

The following components (1) to (6) were mixed at 30° C. to prepare a coating liquid for back surface.

| | |
|---|---|
| (1) Inorganic fine particle dispersion for coating liquid for back surface | 59.5 parts |
| (2) Boric acid | 1.06 parts |
| (3) Polyvinyl alcohol (water-soluble resin) solution | 31.1 parts |
| Composition of the solution | |
| PVA 235 (trade name) (saponification degree; 88%, polymerization degree; 3,500, manufactured by Kuraray Co., Ltd.) | 2.2 parts |
| Polyoxyethylene lauryl ether (surfactant) (EMULGEN 109P (trade name), 10% aqueous solution, HLB value; 13.6, manufactured by Kao Corporation) | 0.72 parts |
| Diethyleneglycol momobutylether (BUTYCENOL 20P (trade name), manufactured by Kyowa Hakko Kogyo Co., Ltd.) | 0.66 parts |
| Ion exchange water | 27.6 parts |
| (4) Ethanol | 2.0 parts |
| (5) Ion exchange water | 3.2 parts |
| (6) Matting agent (P-78D (trade name), aggregated particle diameter; 8 μm, manufactured by Mizusawa Industrial Chemicals, Ltd.) | 0.01 parts |

(Preparation of inorganic fine particle dispersion for coating liquid for front surface)

The following components (1) to (4) were mixed and dispersed by a non-media dispersing machine (ultrasonic dispersing machine manufactured by SMT Co., Ltd.), and the obtained dispersion was heated to 45° C. and maintained at this temperature for 20 hours.

| | |
|---|---|
| (1) Humed silica (inorganic fine particles) (AEROSIL 300SF75 (trade name), manufactured by Nippon Aerosil Co., Ltd., average primary particle diameter; 7 nm) | 10.0 parts |
| (2) Ion exchange water | 62.8 parts |
| (3) SHAROL DC-902P (trade name) (51.5% aqueous solution) (dispersant, manufactured by Dai-Ichi Kogyo Seiyaku Co., Ltd.) | 0.87 parts |
| (4) ZA-30 (trade name) (zirconyl acetate, manufactured by Daiichi Kigenso Kagaku Kogyo Co., Ltd.) | 0.54 parts |

(Preparation of coating liquid for front surface)

The following components (1) to (6) were mixed at 30° C. to form a coating liquid for front surface.

| | |
|---|---|
| (1) Inorganic fine particle dispersion for coating liquid for front surface | 59.5 parts |
| (2) Boric acid | 0.59 parts |
| (3) Polyvinyl alcohol (water-soluble resin) solution | 31.1 parts |
| Composition of solution | |
| PVA 235 (trade name) (saponification degree; 88%, polymerization degree; 3,500, manufactured by Kuraray Co., Ltd) | 2.2 parts |
| Polyoxyethylene lauryl ether (surfactant) (EMULGEN 109P (trade name), 10% aqueous solution, HLB value; 13.6, manufactured by Kao Corporation) | 0.72 parts |
| Diethyleneglycol momobutylether (BUTYCENOL 20P (trade name), manufactured by, Kyowa Hakko Kogyo Co., Ltd.) | 0.66 parts |
| Ion exchange water | 27.6 parts |
| (4) Ethanol | 2.6 parts |
| (5) Ion exchange water | 4.3 parts |
| (6) SUPERFLEX 650 (trade name) (cationic polyurethane, 25% aqueous dispersion, manufactured by Dai-Ichi Kogyo Seiyaku Co., Ltd.) | 2.2 parts |

(Preparation of Ink Recording Sheet)

A corona discharge treatment was conducted on the back surface of the resin coated sheet (thermoplastic resin layer A), and the coating liquid for back surface obtained above was applied on the corona discharge-treated thermoplastic resin layer A to an amount of 50 ml/m$^2$, then dried to form a backside ink receiving layer.

Next, a corona discharge treatment was conducted on the front surface of the resin coated sheet (thermoplastic resin layer B), and the coating liquid for front surface was applied thereon to a coating amount of 183 ml/m$^2$. At this time, an 8% aqueous polyaluminum chloride solution (ALFINE 83 (trade name), manufactured by Daimei Chemicals Co., Ltd.) was added to the coating liquid for front surface immediately before coating such that the aqueous polyaluminum chloride solution is contained at an amount of 12.0 ml/m$^2$. Thereafter, the coated layer was dried with a hot air dryer at 80° C. (air flow rate: 3 to 8 m/second) until the solid concentration in the coated layer became 20%. During this period, the coated layer exhibited a constant drying rate. Before the coated layer exhibited a decreasing-rate in drying, the layer was immersed into a basic solution having the following composition for 3 seconds to adhere the solution to an amount of 13 g/m$^2$, and the layer was further dried at 80° C. for 10 minutes (curing process). In this manner, a front side ink receiving layer with a dry thickness of 32 μm was formed.

Through the above processes, an inkjet recording medium having ink receiving layers on both sides of the resin coated sheet formed by applying a resin on both sides of a base paper was obtained.

| Composition of basic solution | |
|---|---|
| (1) Boric acid | 0.65 parts |
| (2) Zirconyl ammonium carbonate (ZIRCOZOL AC-7 (trade name), 28% aqueous solution, manufactured by Daiichi Kigenso Kagaku Co., Ltd.) | 2.5 parts |
| (3) Ammonium carbonate (1st grade, manufactured by Kanto Chemical Co., Inc.) | 3.5 parts |
| (4) Ion exchange water | 63.3 parts |
| (5) Polyoxyethylene lauryl ether (surfactant) (EMULGEN 109P (trade name), 2% aqueous solution, HLB value; 13.6, manufactured by Kao Corporation) | 30.0 parts |

(Measurement and Evaluation)

With regard to the inkjet recording sheet prepared in the above manner, the following measurements and evaluation were carried out. The results of the measurement and evaluation are shown in Table 1.

(Measurement of Static Friction Coefficient of Back Surface)

The static friction coefficient between the back surface of the inkjet recording medium and a feed roller installed in a printer (PM-G800 (trade name), manufactured by Seiko Epson Corp., Lot No. C55101005NA04702276, a roller having wear-resistant particles (ceramics such as alumina and silicon carbide, average particle diameter of 50 μm) adhered onto a highly rigid roller) was measured in accordance with JIS P8147. As a measuring instrument, a surface property tester (trade name: TRIBOGEAR manufactured by Shinto Scientific Co., Ltd.) was used.

Specifically, first, the feed roller having a cylindrical shape was cut into 6 cm-length by a plane perpendicular to a longitude direction, and the surface (outer periphery) of the cut piece of the roller was fixed to one surface of a stainless steel plate (6 cm square) with an adhesive, and a double-faced adhesive tape was adhered onto the entire area of a surface of the stainless steel plate opposite to the side onto which the roller was adhered, and the roller was fixed to the measuring instrument. Next, a test piece of A4-size sheet was set to the instrument such that a backside surface of the test piece was in contact with the surface of the feed roller, and the static friction coefficient was measured at a test speed of 7 mm/minute.

(Measurement of Average Secondary Particles Diameter of Inorganic Fine Particles)

The average secondary particle diameter of the inorganic fine particles was measured prior to the addition of a matting agent by use of a laser diffraction/light scattering type particle size distribution measuring apparatus (LA-920 (trade name) manufactured by Horiba Ltd.).

(Evaluation of Printability)

Printability of a logo mark onto the back surface of the inkjet recording medium was evaluated in accordance with the following criteria. The results are shown in Table 1.

A: Printing can be performed when the inkjet recording medium is rolled up or cut into an arbitrary size.

B: Printing can be performed, but not onto the inkjet recording medium cut into an arbitrary size.

C: Printing cannot be performed.

(Evaluation of Accuracy of Feeding)

A gray solid image was printed on the inkjet recording medium using a printer (PM-G800: trade name manufactured by Seiko Epson Corp.) at a fine-image mode after printing a logo mark on the back surface of the inkjet recording media, and the uniformity of the printed solid image was visually evaluated in accordance with the following criteria. The results are shown in Table 1.

A: A uniform gray image was obtained.

B: Stripe patterns were slightly observed in a gray solid image at intervals of 2.5 cm (a slight degree of banding).

C: Portions with extremely deep tone and portions with extremely light tone were observed in a gray solid image at intervals of 2.5 cm (a significant degree of banding).

(Evaluation of Offset)

Immediately after printing a logo mark on the back surface, the printed media were stacked and stored. Thereafter, whether or not a color was transferred from a logo mark printed on a back surface of one recording medium to a front surface of another recording medium that was in contact with the printed logo mark was visually observed and evaluated in accordance with the following criteria. The results are shown in Table 1.

A: Offset is not observed at all.

B: Offset is slightly observed.

C: Offset is clearly observed.

(Evaluation of Curling)

An A-4 size sheet (inkjet recording medium) was left for 16 hours or more at a temperature of 27° C. and a humidity of 35%, and the reflexed sheet was put on a plane so as to be convex downward. An average value of the heights from the plane to each of four corners of the sheet was determined as an index of curling, and evaluated in accordance with the following criteria. The results are shown in Table 1.

A: Curling was less than 2.5 mm.

B: Curling was 2.5 mm or more and less than 5 mm.

C: Curling was 5 mm or more.

Example 2

An inkjet recording medium was prepared in a similar manner to Example 1, except that fine particles for coating the back surface were changed to "QS-05" (trade name, manufactured by Tokuyama Corporation). The measurement and evaluation were performed in a similar manner to Example 1. The measurement and the results of the evaluation are shown in Table 1.

Example 3

An inkjet recording medium was prepared in a similar manner to Example 1, except that the fine particles used for coating the back surface was changed to "P-604" (trade name, manufactured by Mizusawa Industrial Chemicals, Ltd.), and that the matting agent was not used. The measurement and evaluation were performed in a similar manner to Example 1. The measurement and the results of the evaluation are shown in Table 1.

Example 4

An inkjet recording medium was prepared in a similar manner to Example 1, except that the coating amount of the back surface layer was changed to 100 ml/m$^2$. The measurement and evaluation were performed in a similar manner to Example 1. The measurement and the results of the evaluation are shown in Table 1.

Example 5

An inkjet recording medium was prepared in a similar manner to Example 1, except that the coating amount of the back surface layer was changed to 20 ml/m$^2$. The measurement and evaluation were performed in a similar manner to Example 1. The measurement and the results of the evaluation are shown in Table 1.

Example 6

An inkjet recording medium was prepared in a similar manner to Example 1, except that the fine particles used for coating the back surface were changed to "SNOWTEX 0-04" (trade name, manufactured by Nissan Chemical Industries, Ltd.). The measurement and evaluation were performed in a similar manner to Example 1. The measurement and the results of the evaluation are shown in Table 1.

Comparative Example 1

An inkjet recording medium was prepared in a similar manner to Example 1, except that the coating amount of the back surface layer was changed to 200 ml/m$^2$. The measurement and evaluation were performed in a similar manner to Example 1. The measurement and the results of the evaluation are shown in Table 1.

Comparative Example 2

An inkjet recording medium was prepared in a similar manner to Example 1, except that the fine particles used for coating the back surface were changed to "P-78A" (trade name, manufactured by Mizusawa Industrial Chemicals, Ltd.), and that the matting agent was not used. The measurement and evaluation were performed in a similar manner to Example 1. The measurement and the results of the evaluation are shown in Table 1.

Comparative Example 3

An inkjet recording medium according to Comparative Example 3 was prepared in a similar manner to Example 1, except that only a layer containing an antistatic agent having the following composition was formed on the back surface in place of the ink receiving layer. The measurement and evaluation were performed in a similar manner to Example 1. The measurement and the results of the evaluation are shown in Table 1.

The layer containing the antistatic agent was prepared by applying a dispersion formed by dispersing aluminum oxide ("ALUMINA SOL 100" (trade name, manufactured by Nissan Chemical Industries, Ltd.)) and silicon dioxide ("SNOWTEX O" (trade name, manufactured by Nissan Chemical Industries, Ltd.)) at a ratio of 1:2 by mass in water, such that the dry amount of the layer was 0.2 g/m$^2$.

Comparative Example 4

Measurement and evaluation were performed in a similar manner to Example 1 using an inkjet recording medium "SP-101DA410" (trade name; manufactured by Canon Inc.). The measurement and the results of the evaluation are shown in Table 1.

Comparative Example 5

An inkjet recording medium was prepared in a similar manner to Example 1, except that the thermoplastic resin layer B was not provided on the front surface. The measurement and evaluation were performed in a manner similar to those of Example 1. The measurement and the results of the evaluation are shown in Table 1.

TABLE 1

| | Backside ink receiving layer | | | Ecaluation results | | | |
|---|---|---|---|---|---|---|---|
| | Static friction coefficient | Average secondary particle size of inorganic fine particles (nm) | Use of Matting agent | Printability | Acrracy of feeding | Offset | Curling |
| Example 1 | 0.46 | 110 | Yes | A | A | A | A |
| Example 2 | 0.54 | 160 | Yes | A | A | A | A |
| Example 3 | 0.42 | 650 | No | A | A | A | A |
| Example 4 | 0.52 | 110 | Yes | A | A | A | B |
| Example 5 | 0.34 | 110 | Yes | A | B | B | A |
| Example 6 | 0.37 | 40 | Yes | B | A | B | A |
| Com. Example 1 | 0.63 | 110 | Yes | A | C | A | C |
| Com. Example 2 | 0.24 | 7500 | No | A | C | A | A |
| Com. Example 3 | 0.37 | — | Yes | C | B | C | A |
| Com. Example 4 | 0.81 | — | No | B | C | A | A |
| Com. Example 5 | 0.46 | 110 | Yes | A | A | A | C |

As shown in Table 1, the inkjet recording media according to Examples 1 to 6 had no problem in printability, and exhibited a high level of accuracy of feeding. Further, no problem offset or curling was observed after printing a logo mark.

On the other hand, Comparative Examples 1, 2 and 4, having a static friction coefficient outside the range of 0.3 to 0.6, exhibited inferior accuracy of feeding. Further, offset was observed in Comparative Example 3 having no ink receiving layer on the back surface.

Comparative Example 5, having no resin coating on the front surface, exhibited unfavorable curling.

As discussed above, the invention can provide an inkjet recording medium and an inkjet recording method with a high accuracy of feeding and suppressed occurrence of offset or curling after printing an image.

All publications, patent applications, and technical standards mentioned in this specification are herein incorporated by reference to the same extent as if each individual publication, patent application, or technical standard was specifically and individually indicated to be incorporated by reference.

What is claimed is:

1. An inkjet recording medium comprising a resin coated sheet formed from a base paper having both sides coated with a resin, and ink receiving layers provided on both sides of the resin coated sheet as outermost layers, wherein a static friction coefficient between at least one of the ink receiving layers and a metal roller onto which wear-resistant particles are adhered is from 0.3 to 0.6.

2. The inkjet recording medium according to claim 1, wherein the ink receiving layer having the static friction coefficient of from 0.3 to 0.6 contains inorganic fine particles having an average secondary particle diameter of 50 nm or more to less than 300 nm and a matting agent having a particle diameter of from 2 to 20 μm.

3. The inkjet recording medium according to claim 2, wherein the inorganic fine particles are at least one selected from inorganic fine particles of amorphous silica, colloidal silica, alumina or pseudo-Boehmite.

4. The inkjet recording medium according to claim 1, wherein the ink receiving layer having the static friction coefficient of from 0.3 to 0.6 contains inorganic fine particles having an average secondary particle diameter of 300 nm or more to less than 1000 nm and a matting agent in an amount of 0.01% by mass with respect to the total ink receiving layer.

5. The inkjet recording medium according to claim 1, wherein the ink receiving layer having the static friction coefficient of from 0.3 to 0.6 is provided on a back surface of the resin coated sheet.

6. The inkjet recording medium according to claim 1, wherein the ink receiving layer having the static friction coefficient of from 0.3 to 0.6 contains a water soluble resin.

7. An inkjet recording method comprising recording an image on at least one surface of an inkjet recording medium, the inkjet recording medium comprising a resin coated sheet formed from a base paper having both sides coated with a resin and ink receiving layers provided on both sides of the resin coated sheet as outermost layers, wherein the recording is performed such that a static friction coefficient between the ink receiving layer onto which the image is recorded and a feed roller in an inkjet printer formed from a metal roller onto which wear-resistant particles are adhered is from 0.3 to 0.6.

8. The inkjet recording medium according to claim 1, wherein the ink receiving layer on which the image is recorded contains at least one kind of inorganic fine particles having an average secondary particle diameter of 50 nm or more to less than 300 nm and a matting agent having a particle diameter of from 2 to 20 μm.

9. The inkjet recording medium according to claim 8, wherein the inorganic fine particles are at least one selected from inorganic fine particles of amorphous silica, colloidal silica, alumina or pseudo-Boehmite.

10. The inkjet recording medium according to claim 1, wherein the ink receiving layer on which the image is recorded contains inorganic fine particles having an average secondary particle diameter of 300 nm or more to less than 1000 nm and a matting agent in an amount of 0.01% by mass with respect to the total ink receiving layer.

* * * * *